US005970987A

United States Patent [19]

Barreiro, Jr.

[11] Patent Number: 5,970,987

[45] Date of Patent: Oct. 26, 1999

[54] LATERALLY AND INTERSTITIALLY VENTED HUMIDOR

[75] Inventor: Armando Barreiro, Jr., Miami, Fla.

[73] Assignee: Cu-Avana, Inc., Miami, Fla.

[21] Appl. No.: 08/893,810

[22] Filed: Jul. 11, 1997

Related U.S. Application Data

[63] Continuation-in-part of application No. 08/831,822, Apr. 2, 1997, abandoned.

[51] Int. Cl.[6] ..... A24F 11/00

[52] U.S. Cl. ..... 131/329; 131/328; 312/31; 454/230

[58] Field of Search ..... 131/329, 328; 312/31, 231, 229; 454/230

[56] References Cited

U.S. PATENT DOCUMENTS 3,023,064 2/1962 Sosa ..... 312/31
3,885,843 5/1975 Rubel ..... 312/31

*Primary Examiner*—John G. Weiss
*Assistant Examiner*—Charles W. Anderson
*Attorney, Agent, or Firm*—Frank L. Kubler

[57] ABSTRACT

A humidor for retaining and preserving cigars includes a housing having a housing bottom wall and a housing top wall, and at least one housing side wall interconnecting the housing bottom wall and housing top wall, an access structure for opening the housing to admit cigars and for closing the housing to retain humidified air, a humidity generating structure, and a venting structure having elements for retaining several of the cigars within the housing spaced apart from the housing side wall to define at least one air circulation passageway between the cigars and the housing side wall. The humidor additionally includes at least one cigar separation sheet in the form of a sheet of resilient material with at least one sheet air passing vent opening for placing between horizontal layers of the cigars to define air circulation passageways between the cigars constituting each layer of cigars. The housing and vent structure are both preferably made of cedar.

10 Claims, 4 Drawing Sheets

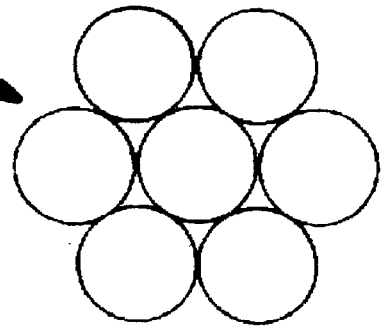
PRIOR ART FIG. 1
FIG. 2
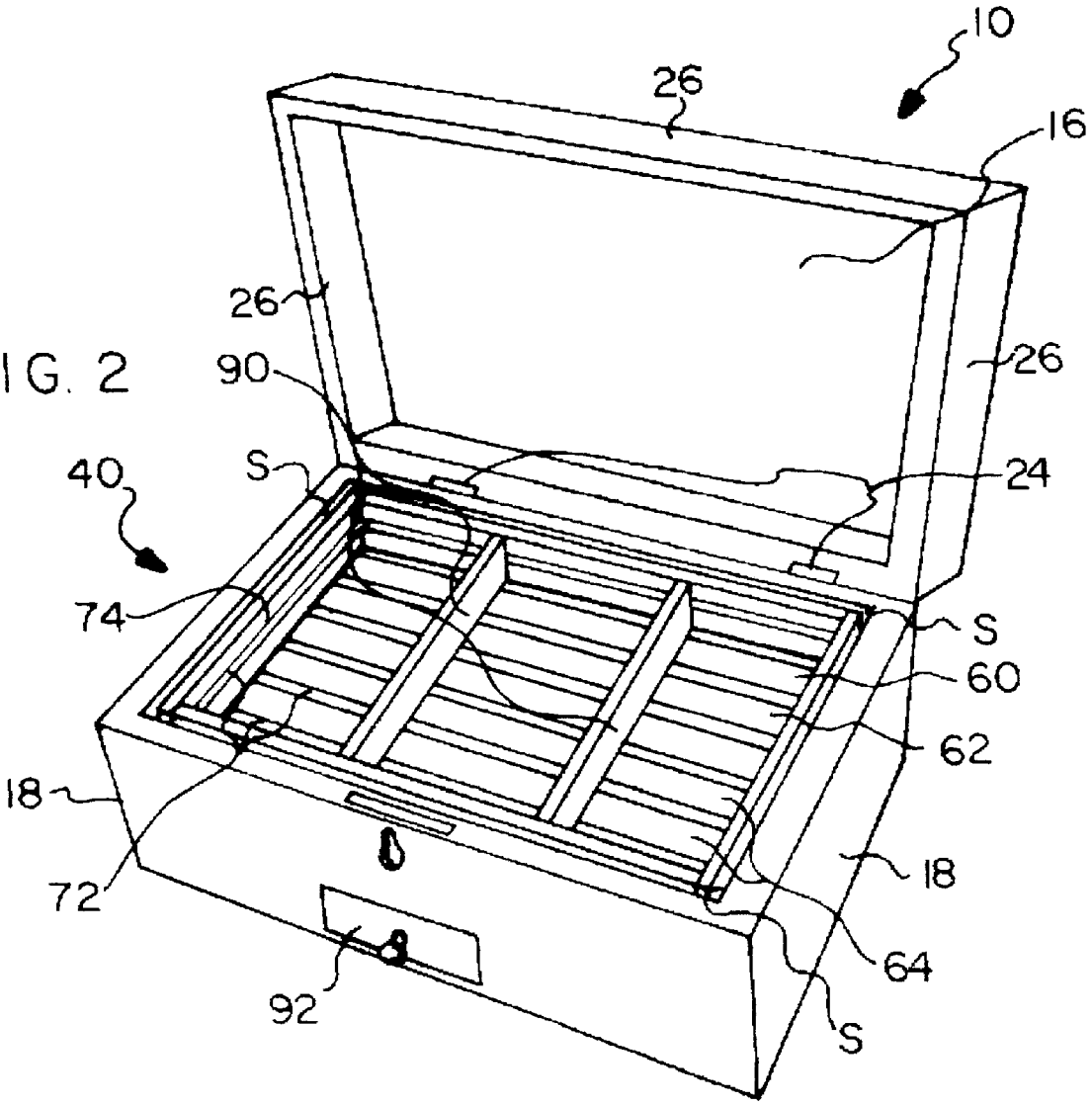

LATERALLY AND INTERSTITIALLY VENTED HUMIDOR

FILING HISTORY

This application is a continuation-in-part of application Ser. No. 08/831,822, abandoned filed on Apr. 2, 1997.

BACKGROUND OF THE INVENTION

1. Field of the Invention

The present invention relates generally to the field of cigar storage and display accessories and paraphernalia. More specifically the present invention relates to a humidor including housing made up of housing bottom and top walls, at least one housing side wall interconnecting the bottom and top walls to form an enclosure, an access structure for opening the housing to admit cigars and for closing the housing to substantially seal the cigar environment, a humidity generating source, and an inventive venting structure which retains cigars within the housing while uniform humidified air access to the cigars. The humidor additionally includes vented cigar layer separation sheets.

The venting structure preferably includes a bottom vent panel spaced above the housing bottom wall and above a humidity generating source by spacing means and at least one side vent panel spaced inwardly from the at least one housing side wall, the bottom vent panel and the at least one side vent panel having air passing vent openings. The vent panels are each formed of a series of spaced apart slats interconnected by panel cross members, the panel cross members preferably also functioning as the spacing means separating the panel slats from the housing bottom and side walls. The spacings between the slats define the panel vent openings which place the interior of the venting structure in substantially uniform communication with air from the humidity generating source. The panel slats are preferably made of cedar.

The cigar layer separation sheets each preferably include a thin sheet of material having a series of elongate venting openings in them. Each sheet is placed on top of a horizontal layer of laterally abutting and parallel cigars so that an upper layer of cigars may be laid on top of the sheet. The separation sheets permit venting between the cigar layers. The sheets are preferably made of cedar.

2. Description of the Prior Art

There have long been humidors for retaining a pile of cigars in a closed, high humidity environment to extend the cigar shelf life. A problem with these prior humidors has been that they do not uniformly distribute humidified air throughout the cigars they contain. The suspended water molecules cannot pass freely and at a sufficient volume rate through the pile of cigars to adequately moisten and maintain the cigars in the middle of the pile. Stacked cigars nestle together closely and leave inadequate interstitial space for moistened air delivery. See Prior Art FIG. 1.

The most common solution found in the existing art has been for the cigar collector to engage in the laborious task of removing and rotating the cigars from time to time. This task is not only a time consuming and uninteresting, but if forgotten or delayed for too long, premium and costly cigars may be prematurely dried and ruined.

It is thus an object of the present invention to provide a humidor which retains multiple layers of cigars for efficient storage.

It is another object of the present invention to provide such a humidor which creates fluid communication all around the cigars for an enveloping delivery of humidified air throughout the cigars.

It is still another object of the present invention to provide such a humidor which creates fluid communication between cigar layers for adequate interstitial delivery of humidified air between cigars.

It is finally an object of the present invention to provide such a humidor which is sturdy, attractive, and economical to manufacture.

SUMMARY OF THE INVENTION

The present invention accomplishes the above-stated objectives, as well as others, as may be determined by a fair reading and interpretation of the entire specification.

A humidor is provided for retaining and preserving cigars, including a housing having a housing bottom wall and a housing top wall, and at least one housing side wall interconnecting the housing bottom wall and housing top wall, an access structure for opening the housing to admit cigars and for closing the housing to retain humidified air, a humidity generating structure, and a venting structure having elements for retaining several of the cigars within the housing spaced apart from the housing side wall to define at least one air circulation passageway between the cigars and the housing side wall.

The humidor preferably additionally includes a vented cigar tray sized to fit substantially horizontally within the housing, the cigar tray having a tray bottom wall with at least one tray vent opening for passing humidified air through the cigar tray, and tray support structure within the housing for retaining the cigar tray at a certain distance above the housing bottom wall. The venting structure preferably includes a bottom vent panel spaced above the housing bottom wall by a spacing structure and at least one side vent panel spaced apart from the housing side wall, the bottom vent panel and the side vent panel including a substantially parallel series of slat members interconnected by interconnection members and being laterally spaced apart to define several of the venting structure vent openings.

The vented cigar tray preferably includes a tray bottom panel having a substantially parallel series of slat members interconnected by interconnection members and being laterally spaced apart to define several of the tray vent openings, and preferably includes tray side panels having a tray side panel vent opening.

The humidor preferably additionally includes at least one cigar separation sheet in the form of a sheet of resilient material with at least one sheet air passing vent opening for placing between horizontal layers of the cigars to define air circulation passageways between the cigars constituting each layer of cigars. The housing and vent structure are both preferably made of cedar.

BRIEF DESCRIPTION OF THE DRAWINGS

Various other objects, advantages, and features of the invention will become apparent to those skilled in the art from the following discussion taken in conjunction with the following drawings, in which:

Prior Art FIG. 1 is an end view of cigars stacked in the conventional pile within a prior art humidor, providing inadequate interstitial space between the cigars for circulation of humidified air.

FIG. 2 is a perspective front view of the larger version of the present humidor, containing a tray with removable tray partitions.

DETAILED DESCRIPTION OF THE PREFERRED EMBODIMENTS

Figure 3:
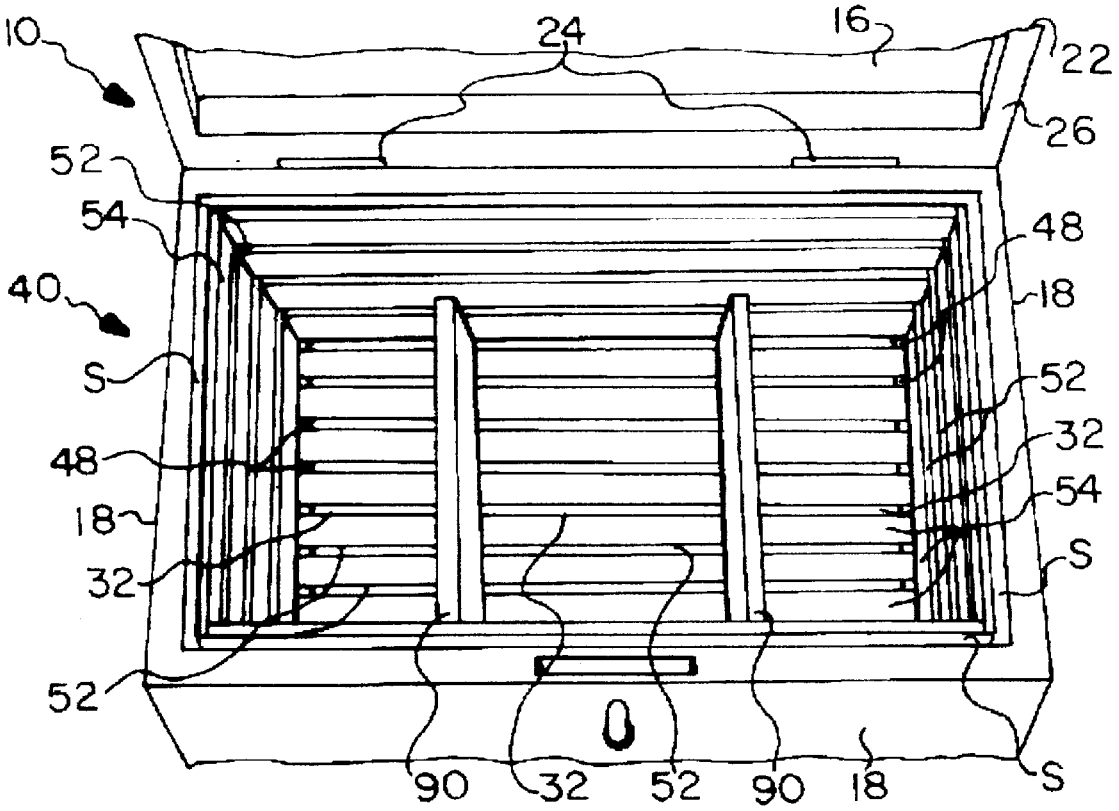
FIG. 3 is a close-up top view looking into the humidor of FIG. 2, showing the spaced apart slats of the venting structure.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–9, a humidor 10 is disclosed including a housing 12 made up of a housing bottom wall 14 and having a top wall 16, housing side walls 18 interconnecting bottom and top walls 14 and 16, an access structure 20 for opening housing 12 to admit cigars C and for closing to substantially seal housing 12, a humidity generating source 30, and a venting structure 40 which retains cigars C within housing 12 while uniformly exposing the cigars C to humidified air.

Figure 4:
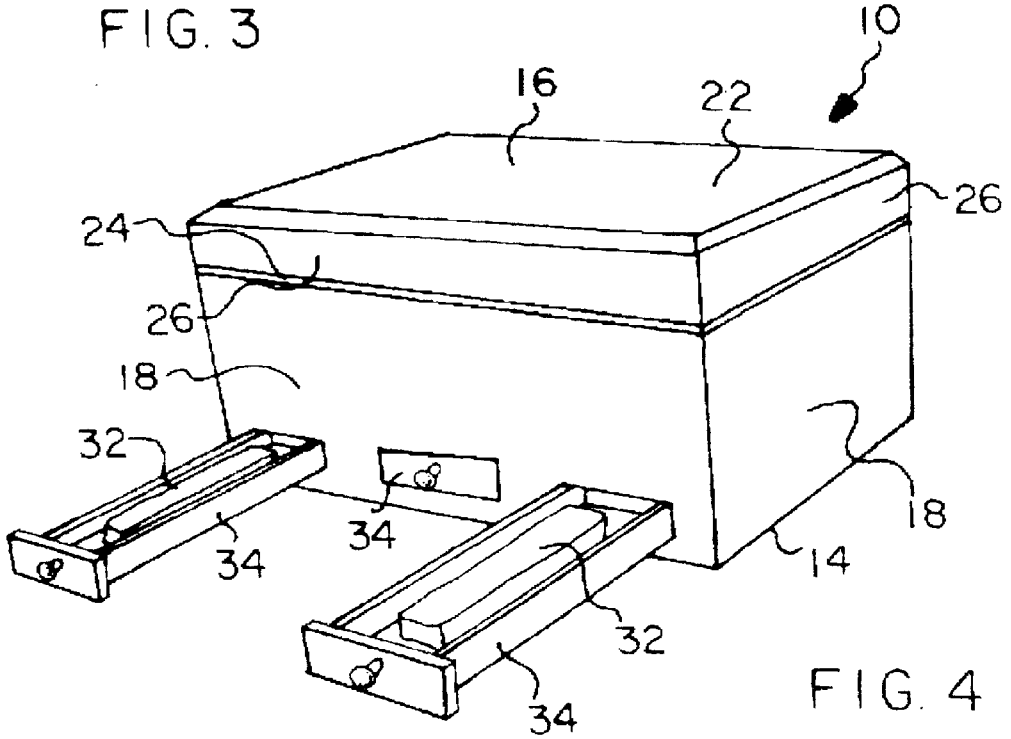
FIG. 4 is a rear view of the humidor of FIG. 2 showing two of the sponge retaining drawers pulled out for addition of water.
Figure 5:
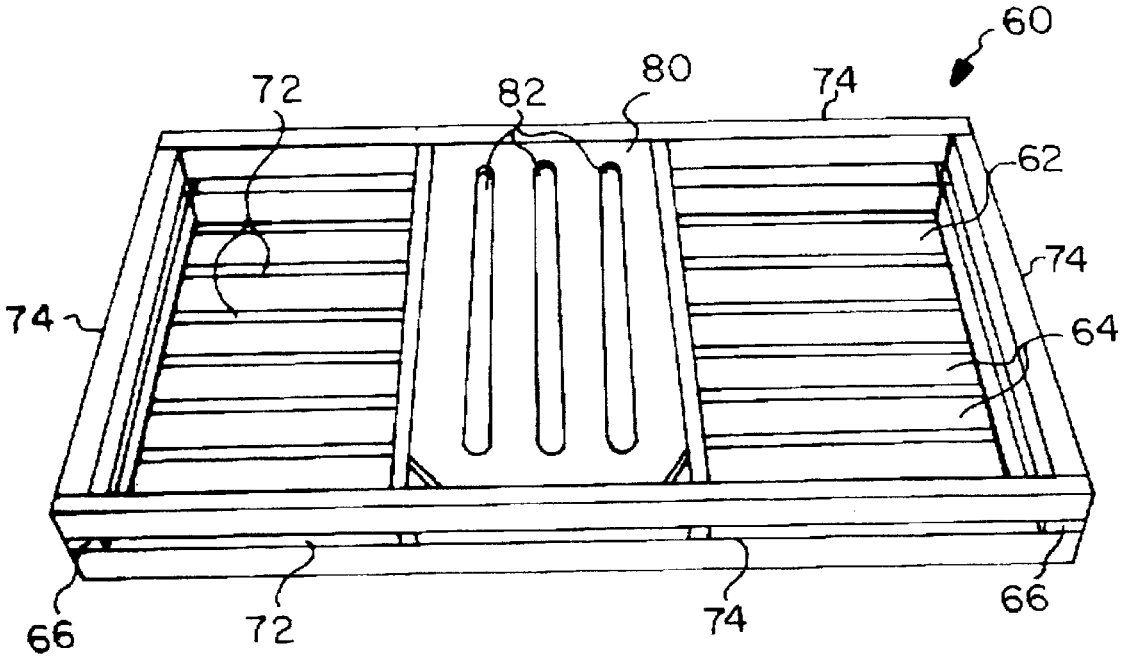
FIG. 5 is a perspective top view of a vented tray, containing two tray partitions and a layer of cigars in the middle compartment being covered by a separation sheet.
Figure 6:
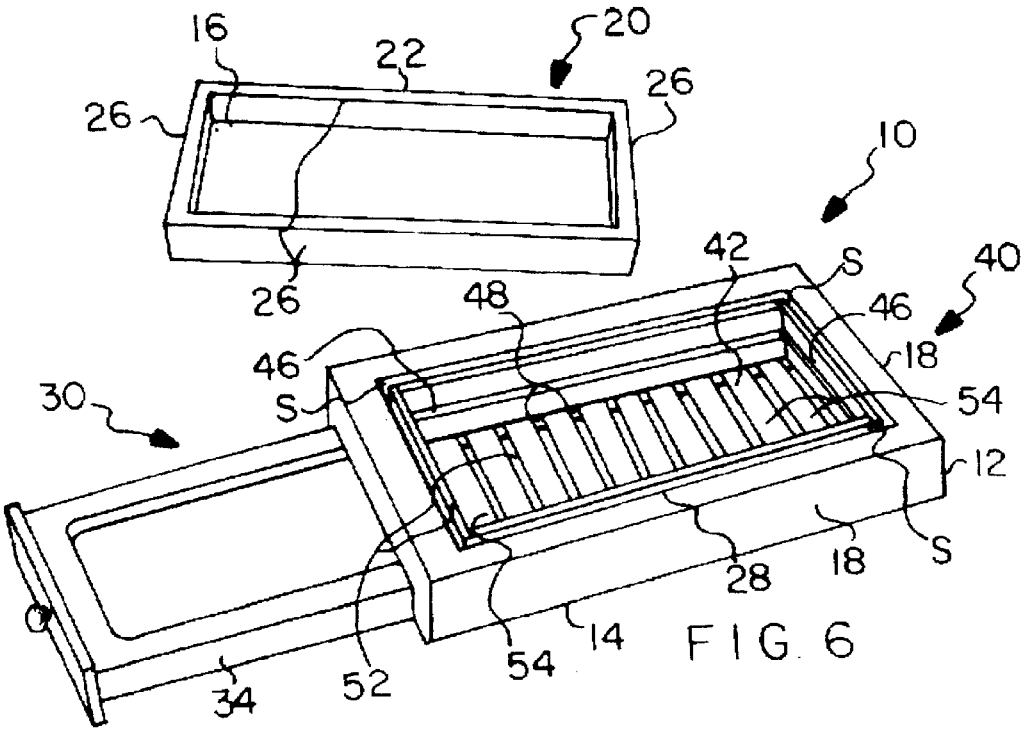
FIG. 6 is a perspective view of the smaller version of the present humidor having the lid removed and placed to one side and the sponge retaining drawer pulled out, containing no sponge.
Figure 7:
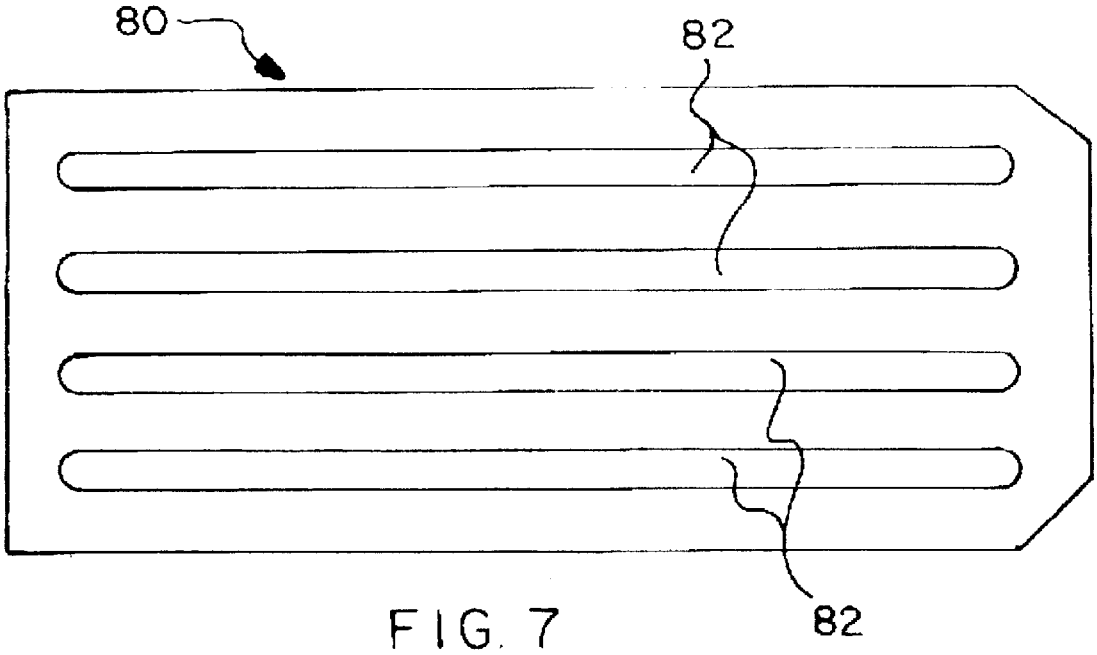
FIG. 7 is a plan view of one of the separation sheets.
Figure 9:
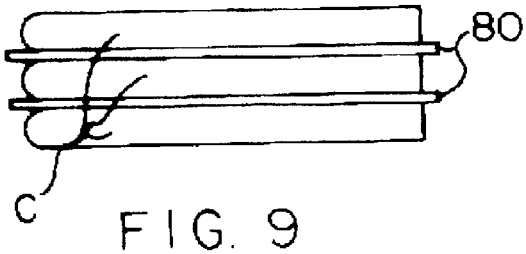
FIG. 9 is a side view of the cigars and separation sheets of FIG. 8.
Figure 8:
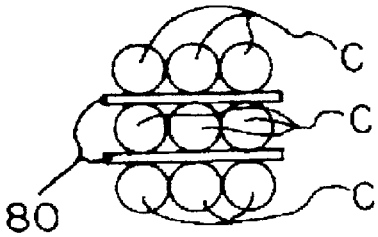
FIG. 8 is an end view of cigars in the present humidor separated into cigar layers by separation sheets.

Larger versions of humidor 10 additionally include vented cigar tier separation trays 60 so that the weight of a large number of cigars C within housing 12 does not damage those at the bottom and to permit rapid access to lower cigar C levels by lifting trays 60 out of housing 12. FIG. 6 shows a single tier humidor 10 requiring no separation trays 60 and FIGS. 2–4 show a larger humidor 10 having several levels of trays 60.

Humidity generating source 30 is preferably a sponge 32 moistened with water and retained within a compartment on housing bottom wall 14. The compartment is preferably a drawer 34 slidably retained in guide tracks 36 on housing bottom wall 14, the drawer 34 slidably opening out of one of the housing side walls 18 for periodic addition of water to the sponge 32.

Venting structure 40 preferably includes a bottom vent panel 42 spaced above housing bottom wall 14 and above humidity generating source 30 by spacing rails 44 and venting structure side vent panels 46 spaced inwardly by spaces S from housing side walls 18 by spacer rails 48, the bottom and side vent panels 42 and 46 having air passing vent openings 52. Vent panels 42 and 46 are each formed of a series of spaced apart slats 54 interconnected and spaced apart from housing bottom and side walls 14 and 18 by cross members in the form of spacer rails 48. The lateral spacings between the slats 54 define the panel vent openings 52 which place the interior of the venting structure 40 in substantially uniform communication with air from humidity generating source 30. Panel slats 54 are preferably made of cedar.

The cigar tier separation trays 60 each include a tray bottom panel 62 including a substantially parallel series of slat members 64 interconnected by interconnection members 66 and being laterally spaced apart to define several tray vent openings 72. The vented cigar trays 60 each include tray side panels 74 having a tray side panel vent openings 72. The trays 60 rest on stop tabs protruding inwardly from corners of housing walls 18 through venting structure 40.

A preferred feature of humidor 10 are several cigar separation sheets 80, each preferably including a thin sheet of material having a series of elongate and parallel venting openings 82 in them. Each sheet 80 is placed on top of a layer of laterally abutting parallel cigars C so that an upper layer of cigars C may be laid on top of the sheet 80 and venting between the layers is maintained. The sheets 80 are preferably sized to fit within tray 60 compartments separated by tray partitions 90 and have cut away corners for ease of user gripping of sheets 80. The sheets 80 are preferably made of cedar.

Housing 12 is preferably an elongate cube and the side walls 18 are preferably four perpendicularly interconnected side walls. Access structure 20 is preferably a housing lid 22 connected to the upper end of one of the housing side walls 18 with a hinge 24. Lid 22 preferably has lid flanges 26 corresponding in position and length to housing side walls 18. The upper surfaces of the four side walls 18 preferably each include an upwardly projecting sealing lip 28 which fits snugly within the lid flanges 26. Housing 12 is also preferably made entirely of cedar, except for optional metal portions of lid latching and hinge structures. A humidity measuring instrument drawer 92 is preferably provided in the front housing wall 18.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A humidor including cigars, comprising:

a housing comprising a housing bottom wall and a housing top wall, and at least one housing side wall interconnecting said housing bottom wall and housing top wall, an access structure for opening said housing to admit cigars and for closing said housing to retain humidified air, humidity generating means, and a venting structure having means for retaining a plurality of the cigars within said housing spaced apart from said housing side wall to define at least one air circulation passageway between the cigars and said housing side wall, wherein said venting structure comprises a bottom vent panel spaced above said housing bottom wall by spacing means and at least one side vent panel spaced apart from said housing side wall, such that humidified air circulates around the bottom, sides and top of said cigars for uniformity of cigar exposure to humidified air.

2. The humidor including cigars of claim 1, additionally comprising:

a vented cigar tray sized to fit substantially horizontally within said housing, said cigar tray having a tray bottom wall with at least one tray vent opening for passing humidified air through said cigar tray, and tray support means within said housing for retaining said cigar tray at a certain distance above said housing bottom wall.

3. The humidor including cigars of claim 1, wherein said venting structure comprises a bottom vent panel spaced above said housing bottom wall by spacing means and at least one side vent panel spaced apart from said housing side wall, said bottom vent panel and said side vent panel comprising a substantially parallel series of slat members interconnected by interconnection members and being laterally spaced apart to define a plurality of said venting structure vent openings.

4. The humidor including cigars of claim 1, wherein said vented cigar tray comprises:

a tray bottom panel comprising a substantially parallel series of slat members interconnected by interconnection members and being laterally spaced apart to define a plurality of said tray vent openings.

5. The humidor including cigars of claim 4, wherein said vented cigar tray comprises tray side panels having a tray side panel vent opening.

6. The humidor including cigars of claim 1, additionally comprising at least one cigar separation sheet comprising a sheet of resilient material with at least one sheet air passing vent opening for placing between horizontal layers of the cigars to define air circulation passageways between the cigars constituting each said layer of cigars.

7. The humidor including cigars of claim 1, additionally comprising at least one cigar separation sheet comprising a sheet of resilient material with at least one sheet air passing vent opening for placing between horizontal layers of the cigars to define air circulation passageways between the cigars constituting each said layer of cigars.

8. The humidor including cigars of claim 1, wherein said housing and said vent structure are made of cedar.

9. The humidor including cigars of claim 1, wherein said housing and said vent structure are made of cedar.

10. A humidor including cigars, comprising:

a housing comprising a housing wall, an access structure for opening said housing to admit cigars and for closing said housing to retain humidified air, humidity generating means, and at least one cigar separation sheet comprising a sheet of resilient material with at least one sheet air passing vent opening extending between horizontal layers of the cigars to define air circulation passageways between the cigars constituting each said layer of cigars.

* * * * *